US012674596B2

(12) United States Patent
Park et al.

(10) Patent No.: US 12,674,596 B2
(45) Date of Patent: Jul. 7, 2026

(54) AIR CONDITIONER

(71) Applicant: LG ELECTRONICS INC., Seoul (KR)

(72) Inventors: Noma Park, Seoul (KR); Changmin Choi, Seoul (KR); Sunghwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 294 days.

(21) Appl. No.: 18/035,999

(22) PCT Filed: Nov. 12, 2021

(86) PCT No.: PCT/KR2021/016518
§ 371 (c)(1),
(2) Date: May 9, 2023

(87) PCT Pub. No.: WO2022/103193
PCT Pub. Date: May 19, 2022

(65) Prior Publication Data

US 2023/0408129 A1 Dec. 21, 2023

(30) Foreign Application Priority Data

Nov. 12, 2020 (KR) ..... 10-2020-0151054

(51) Int. Cl.
*F24F 11/65* (2018.01)

(52) U.S. Cl.
CPC ..... *F24F 11/65* (2018.01)

(58) Field of Classification Search
CPC ..... F24F 11/65
See application file for complete search history.

(56) References Cited

FOREIGN PATENT DOCUMENTS

| | | | |
|---|---|---|---|
| CN | 1105789889 A | * | 12/2019 |
| EP | 3460349 A1 | * | 3/2019 |
| JP | H1030853 A | * | 2/1998 |
| JP | H11351648 A | * | 12/1999 |

(Continued)

OTHER PUBLICATIONS

Hamada et al., Air Conditioning System, Oct. 7, 2013, JP2013204899A, Whole Document (Year: 2013).*

(Continued)

*Primary Examiner* — Larry L Furdge
(74) *Attorney, Agent, or Firm* — KED & ASSOCIATES

(57) ABSTRACT

An air conditioner including an outdoor unit; at least one indoor unit configured to cool and heat an indoor space while repeating operation (Thermo-ON) and operation stop (Thermo-OFF); a sensor unit configured to measure a temperature and humidity of each indoor space in which the at least one indoor unit is located; and a controller. The controller calculates a sensible heat load and a latent heat load of each indoor space, based on a time when the operation stop occurs, a time when the operation starts again after the operation stop occurs, and temperature and humidity information of each indoor space, derives target sensible heat and target latent heat based on the calculated sensible heat load and latent heat load, and derives a target refrigerant temperature and an air volume of the at least one indoor unit based on the target sensible heat and the target latent heat.

11 Claims, 10 Drawing Sheets

(56) References Cited

FOREIGN PATENT DOCUMENTS

| | | | | |
|---|---|---|---|---|
| JP | 2013204899 | A | * | 10/2013 |
| JP | 2017-163609 | | | 9/2017 |
| JP | 2018-194254 | | | 12/2018 |
| KR | 10-2018-0093162 | | | 8/2018 |
| KR | 10-2019-0115892 | | | 10/2019 |
| KR | 10-2019-0120564 | | | 10/2019 |
| WO | WO 2020/035908 | | | 2/2020 |

OTHER PUBLICATIONS

Fang et al., Method for Controlling Evaporation Pressure of Air Conditioner Evaporator, Dec. 17, 2019, Whole Document (Year: 2019).*

Uekusa et al., Controller for Air Conditioner, Feb. 3, 1998, JPH1030853A, Whole Document (Year: 1998).*

Umehara et al., Humidifier and Air Conditioner, Dec. 24, 1999, JPH11351648A, Whole Document (Year: 1999).*

International Search Report dated Mar. 8, 2022 issued in Application No. PCT/KR2021/016518.

Korean Office Action issued in Application No. 10-2020-0151054 dated Mar. 17, 2025.

* cited by examiner (a)

(b)

AIR CONDITIONER

CROSS-REFERENCE TO RELATED PATENT APPLICATIONS

This application is a U.S. National Stage Application under 35 U.S.C. § 371 of PCT Application No. PCT/KR2021/016518, filed Nov. 12, 2021, which claims priority to Korean Patent Application No. 10-2020-0151054, filed Nov. 12, 2020, whose entire disclosures are hereby incorporated by reference.

TECHNICAL FIELD

The present disclosure relates to an air conditioner, and more specifically, to an air conditioner for deriving a target refrigerant temperature and an air volume of an indoor unit based on a sensible heat load and a latent heat load of an indoor space, and deriving the number of rotations of outdoor fan at which a coefficient of performance is maximized.

BACKGROUND ART

An air conditioner is installed to provide a more comfortable indoor environment to humans by discharging cool or warm air into a room to adjust the indoor temperature and to purify the indoor air in order to create a comfortable indoor environment. In general, an air conditioner includes an indoor unit which is configured of a heat exchanger and installed indoors, and an outdoor unit which is configured of a compressor and a heat exchanger and supplies refrigerant to the indoor unit.

The air conditioner operates in a cooling operation or a heating operation according to the flow of the refrigerant. During cooling operation, high-temperature, high-pressure liquid refrigerant is supplied to the indoor unit from the compressor of the outdoor unit through the heat exchanger of the outdoor unit, the temperature of the surrounding air decreases as the refrigerant expands and vaporizes in the heat exchanger of the indoor unit, and cool air is discharged into the room as an indoor unit fan rotates. During heating operation, high-temperature, high-pressure gaseous refrigerant is supplied from the compressor of the outdoor unit to the indoor unit, and the air warmed by the energy, which is emitted when the high-temperature, high-pressure gaseous refrigerant is liquefied in the heat exchanger of the indoor unit, is discharged into the room according to the operation of the indoor unit fan.

Meanwhile, the cooling and heating efficiency of the air conditioner may increase as the load of the indoor space to be cooled/heated in which the air conditioner is installed is accurately measured. If the sensible heat load and latent heat load of a target space are accurately derived, and the cooling and heating supply capacity of the air conditioner is set based on this, the cooling and heating efficiency can be increased. However, since a conventional air conditioner sets a fixed target pressure and controls to follow it, there is a limit to increasing the cooling and heating efficiency due to the lack of accurate load matching.

In addition, since the power consumption of the outdoor fan in a multi-system air conditioner is 10% or less of the power consumption of the compressor in most cases, the outdoor fan is generally set at the maximum rotational speed. However, in a partial load condition, the portion of the outdoor fan power consumption in the total power consumption increases due to the decrease in the power consumption of the compressor. Hence, it is necessary to accurately control the rotational speed of the outdoor fan.

Since the change in the rotational speed of the outdoor fan affects the increase or decrease of the compression ratio, it affects the power consumption of the compressor. Therefore, it is necessary to accurately control the rotational speed of the outdoor fan in order to optimize the performance and power consumption of the outdoor fan and the compressor.

However, since most conventional air conditioners set a target pressure and control to follow it, there is a problem in that the rotational speed of the outdoor fan capable of maximizing the efficiency of the air conditioner cannot be accurately derived.

DISCLOSURE

Technical Problem

In order to solve the above problems, an object of the present disclosure is to provide an air conditioner that measures indoor temperature and indoor humidity at the time of operation and operation stop of an indoor unit and calculates the sensible heat load and latent heat load of an indoor space based on the measurement.

Another object of the present disclosure is to provide an air conditioner that sets target sensible heat and target latent heat based on the calculated sensible heat load and latent heat load, and determines a target refrigerant temperature and an air volume of an indoor unit based on the set target sensible heat and latent heat.

In addition, another object of the present disclosure is to provide an air conditioner that calculates and controls the rotational speed of an outdoor fan at which a coefficient of performance is maximized, by deriving the number of rotations at which a change rate of total power consumption with respect to a change in the number of rotations of outdoor fan is minimized.

The tasks of the present disclosure are not limited to the tasks mentioned above, and other tasks not mentioned will be clearly understood by those skilled in the art from the following description.

Technical Solution

According to an aspect of the present disclosure, there is provided an air conditioner including: an outdoor unit; at least one indoor unit configured to cool and heat an indoor space while repeating operation (Thermo-ON) and operation stop (Thermo-OFF); a sensor unit configured to measure a temperature and humidity of each indoor space where the at least one indoor unit is located; and a controller, wherein the controller calculates a sensible heat load and a latent heat load of each indoor space, based on a time when the operation stop occurs, a time when the operation starts again after the operation stop occurs, and temperature and humidity information of each indoor space, derives target sensible heat and target latent heat based on the calculated sensible heat load and latent heat load, and derives a target refrigerant temperature and an air volume of the at least one indoor unit based on the target sensible heat and the target latent heat.

According to another aspect of the present disclosure, the sensor unit measures a first indoor temperature and a first indoor humidity at a first time when the operation stop of the at least one indoor unit occurs, and measures a second indoor temperature and a second indoor humidity at a second time when the operation starts again after the first time, wherein the controller derives a temperature change rate of each indoor space during an operation stop time by using the first time, the second time, the first indoor temperature, and the second indoor temperature, and calculates the sensible heat load of each indoor space based on the temperature change rate and a volume of each indoor space, and derives an enthalpy change rate of each indoor space during the operation stop time by using the first time, the second time, the first indoor humidity, and the second indoor humidity, and calculates the latent heat load of each indoor space, based on the enthalpy change rate, the volume of each indoor space, and the sensible heat load.

According to another aspect of the present disclosure, the target sensible heat is set to be larger by a preset ratio in comparison with the sensible heat load, and the target latent heat is set to be larger by a preset ratio in comparison with the latent heat load.

According to another aspect of the present disclosure, the controller determines an operation mode, and when the operation mode is a cooling mode, if the latent heat load is 0, derives the air volume of the indoor unit based on the target sensible heat and a target supply air temperature of the indoor unit, and if the latent heat load is a positive number, derives the air volume of the indoor unit based on the target latent heat.

According to another aspect of the present disclosure, when the operation mode is a heating mode, the controller derives the air volume of the indoor unit based on the target sensible heat and the target supply air temperature of the indoor unit.

According to another aspect of the present disclosure, the controller determines the target refrigerant temperature based on the target sensible heat, wherein the target refrigerant temperature is determined further based on the number of the indoor units, a ratio of rated cooling/heating capacity of each of the indoor units, a sensible heat exchange effectiveness, an air mass flow of indoor unit, and an indoor temperature.

According to another aspect of the present disclosure, the controller derives the number of rotations of an outdoor fan that maximizes a coefficient of performance (COP).

According to another aspect of the present disclosure, the coefficient of performance is a value obtained by dividing a heating/cooling capacity by a total power consumption, wherein the total power consumption is a value obtained by adding power consumptions of a compressor, an indoor fan, and the outdoor fan, wherein the number of rotations of outdoor fan is derived from the number of rotations satisfying a condition in which a change rate of the total power consumption due to a change in the number of rotations of outdoor fan is zero.

According to another aspect of the present disclosure, the controller determines an operation mode, and when the operation mode is a cooling mode, calculates an effective heat capacity, calculates a discharge temperature change according to a condensation temperature change, and derives the number of rotations of outdoor fan by applying the calculated effective heat capacity and the calculated discharge temperature change according to the condensation temperature change to the condition in which the change rate of the total power consumption due to the change in the number of rotations of outdoor fan is zero.

According to another aspect of the present disclosure, the controller determines an operation mode, and when the operation mode is a heating mode, calculates a dew point temperature, and if the calculated dew point temperature is higher than a heat exchanger temperature, determines the number of rotations of outdoor fan as a maximum number of rotations, and if the calculated dew point temperature is lower than the heat exchanger temperature, calculates an effective heat capacity, and calculates a discharge temperature change rate according to an evaporation temperature change, and derives the number of rotations of the outdoor fan by applying the calculated effective heat capacity and the calculated discharge temperature change rate according to the evaporation temperature change to the condition in which the change rate of the total power consumption due to the number of rotations of outdoor fan is zero.

According to another aspect of the present disclosure, the effective heat capacity is a change rate of a difference between discharge enthalpy and suction enthalpy according to the condensation temperature change or the evaporation temperature change.

Details of other embodiments are included in the detailed description and drawings.

Advantageous Effects

According to embodiments of the present disclosure, there are the following effects.

According to at least one of the embodiments of the present disclosure, indoor temperature and indoor humidity are measured at the time of operation and operation stop of the indoor unit, and based on the measurement, sensible heat load and latent heat load of the indoor space are calculated, thereby improving the accuracy of the indoor space load matching.

According to at least one of the embodiments of the present disclosure, the cooling and heating efficiency of the air conditioner may be increased by determining a target refrigerant temperature and an air volume of the indoor unit based on the calculated sensible heat load and latent heat load.

According to at least one of the embodiments of the present disclosure, the efficiency of the air conditioner may be maximized by calculating the number of rotations of outdoor fan at which the coefficient of performance is maximized.

Further scope of applicability of the present disclosure will become apparent from the following detailed description. However, it should be understood that the detailed description and specific embodiments such as preferred embodiments of the present disclosure are given by way of illustration only, since various changes and modifications within the spirit and scope of the present disclosure may be clearly understood by those skilled in the art.

MODE FOR INVENTION

Description will now be given in detail according to exemplary embodiments disclosed herein, with reference to the accompanying drawings. For the sake of brief description with reference to the drawings, the same or equivalent components may be denoted by the same reference numbers, and description thereof will not be repeated.

In general, suffixes such as "module" and "unit" may be used to refer to elements or components. Use of such suffixes herein is merely intended to facilitate description of the specification, and the suffixes do not have any special meaning or function.

In the present disclosure, that which is well known to one of ordinary skill in the relevant art has generally been omitted for the sake of brevity. The accompanying drawings are used to assist in easy understanding of various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are only used to distinguish one element from another.

It will be understood that when an element is referred to as being "connected with" another element, there may be intervening elements present. In contrast, it will be understood that when an element is referred to as being "directly connected with" another element, there are no intervening elements present.

A singular representation may include a plural representation unless context clearly indicates otherwise.

Figure 1:
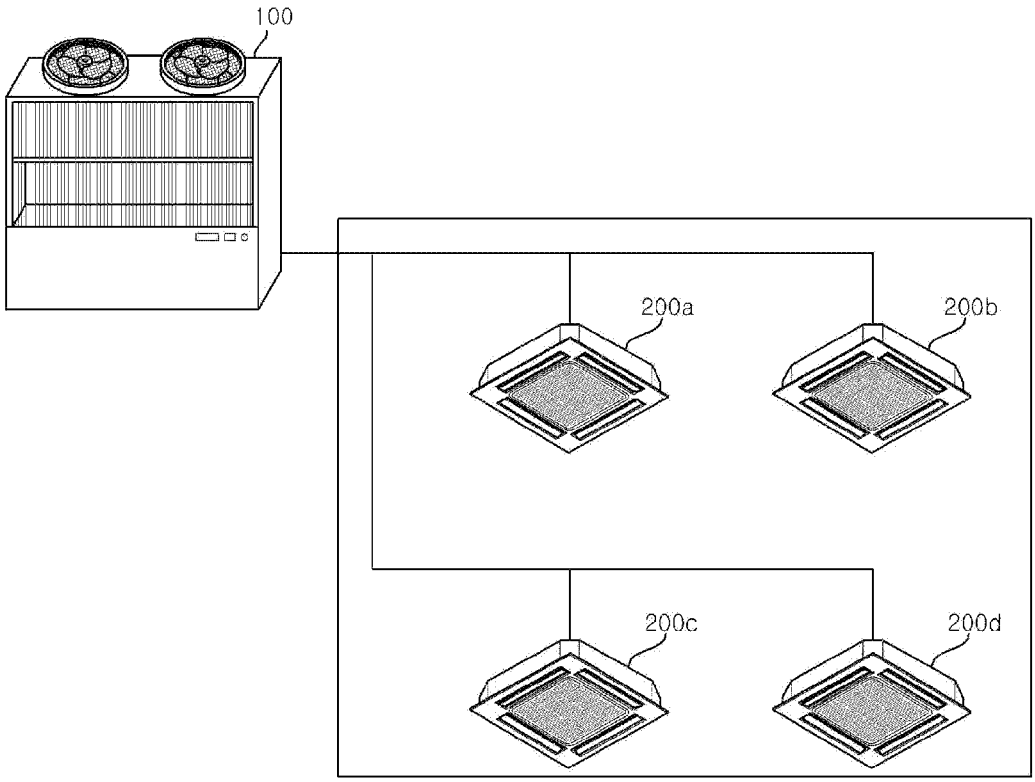
FIG. 1 is a diagram illustrating an air conditioner of the present disclosure.

FIG. 1 is a diagram illustrating an air conditioner 10 of the present disclosure.

Referring to FIG. 1, the air conditioner 10 may include at least one indoor unit 200, 200*a*, 200*b*, 200*c*, 200*d*, and an outdoor unit 100 connected to the at least one indoor unit 200.

The indoor unit 200 of the air conditioner 10 can be applied to any of a stand-type air conditioner, a wall-mounted air conditioner, and a ceiling-type air conditioner, but a ceiling-type indoor unit 200 is exemplified in the drawing. In addition, the drawing shows that there are four indoor units 200, but there may be a single or a plurality of indoor units 200, and the number of indoor units 200 is not limited to those shown in the drawing.

The air conditioner 10 may further include at least one of a ventilation device, an air cleaning device, a humidifier, and a heater, and may operate in conjunction with the operations of the indoor unit 200 and the outdoor unit 100.

The outdoor unit 100 may include, for example, a compressor (not shown) for receiving and compressing a refrigerant, an outdoor heat exchanger (not shown) for exchanging heat between the refrigerant and outdoor air, an accumulator (not shown) that extracts gaseous refrigerant from the supplied refrigerant and supplies it to the compressor, a four-way valve (not shown) for selecting a flow path of refrigerant according to heating operation, a plurality of sensors (not shown), an oil recovery device, and the like. In addition, the outdoor unit 100 further includes, for example, a plurality of valves, but a detailed description of the configuration will be omitted.

The outdoor unit 100 may operate a compressor and an outdoor heat exchanger provided thereto and compress or heat exchange the refrigerant according to setting to supply refrigerant to at least one indoor unit 200. The outdoor unit 100 may be driven by a remote controller (not shown) or a demand of the indoor unit 200. The number of outdoor units 100 may be plural. In this case, as the cooling/heating capacity is varied in correspondence with the driven indoor unit 200, the operating number of the outdoor units 100 and the operating number of compressors installed in the outdoor unit 100 may also be varied.

The outdoor unit 100 may supply compressed refrigerant to at least one connected indoor unit 200. At least one indoor unit 200 may receive refrigerant from the outdoor unit 100 and discharge cold air or warm air into the room. The indoor unit 200 may include an indoor heat exchanger (not shown), an indoor unit fan (not shown), an expansion valve (not shown) through which supplied refrigerant expands, and a plurality of sensors (not shown).

The outdoor unit 100 and the indoor unit 200 are connected by a communication line to transmit and receive data to each other, and are connected to a remote controller (not shown) by wire or wirelessly and operate under the control of a remote controller (not shown).

A remote controller (not shown) may be connected to the indoor unit 200, input a user's control command to the indoor unit 200, and receive and display state information of the indoor unit 200. At this time, the remote controller may communicate with the indoor unit 200 by wire or wirelessly according to a connection type.

Figure 2:
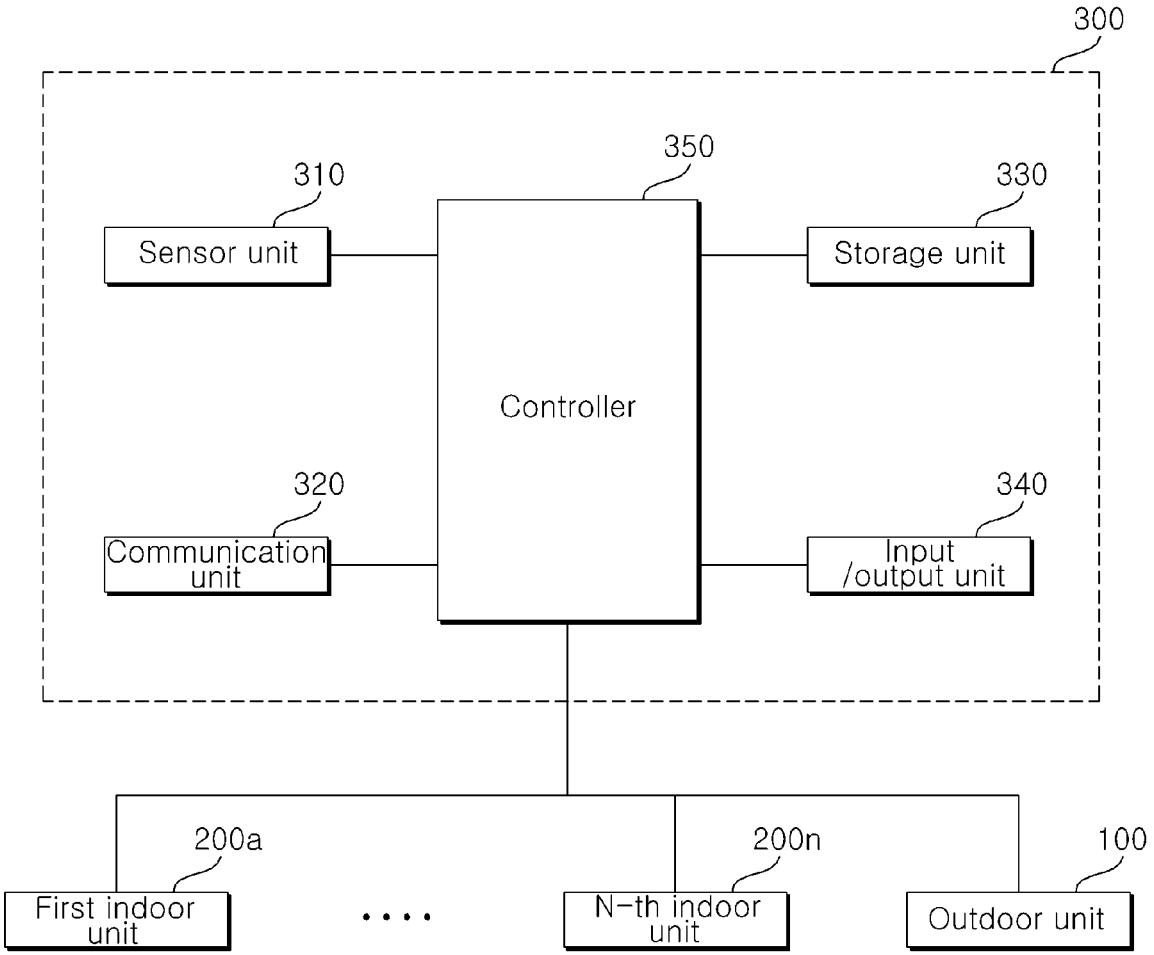
FIG. 2 is a block diagram of the air conditioner of the present disclosure.

FIG. 2 is a block diagram of the air conditioner 10 of the present disclosure.

Referring to FIG. 2, the air conditioner 10 may include an outdoor unit 100, at least one indoor unit 200, 200*a*, . . . , 200*n*, a sensor unit 310, and a controller 350.

The at least one indoor unit 200 is installed in each indoor space, and may cool/heat each indoor space while repeatedly operating (Thermo-ON) and stopping (Thermo-OFF) operation.

The sensor unit 310 may include a plurality of sensors and may transmit data about detection values detected through the plurality of sensors to the controller 350.

For example, the sensor unit 310 may include an indoor temperature sensor (not shown) for detecting indoor temperature, an outdoor temperature sensor (not shown) for detecting outdoor temperature, an indoor humidity sensor (not shown) for detecting indoor humidity, a heat exchanger temperature sensor (not shown) that is disposed inside the heat exchanger of the outdoor unit side and detects a condensation temperature or an evaporation temperature, a pressure sensor (not shown) for detecting the pressure of the gaseous refrigerant flowing through each pipe of the air conditioner 10, a pipe temperature sensor (not shown) for detecting the temperature of the gaseous refrigerant flowing through each pipe of the air conditioner 10, and the like. The sensor unit 310 may measure the indoor temperature and indoor humidity of each indoor space where at least one indoor unit 200 is located.

The controller 350 may be connected to each component provided in the air conditioner 10, and may control overall operation of each component. The controller 350 may transmit/receive data to/from each component provided in the air conditioner 10.

The controller 350 may include at least one processor. Here, the processor may be a general processor such as a central processing unit (CPU). Obviously, the processor may be a dedicated device such as an ASIC or other hardware-based processor.

The controller 350 may be provided in at least one of the outdoor unit 100 and at least one indoor unit 200.

The controller 350 may calculate sensible heat load and latent heat load of each indoor space based on information on the temperature and humidity of the indoor space at the operation time and operation stop time of at least one indoor unit 200, derive target sensible heat and target latent heat of at least one indoor unit 200 based on the calculated sensible heat load and latent heat load, derive a target refrigerant temperature and an air volume of indoor unit based on the target sensible heat and the target latent heat, and control the operation of at least one indoor unit 200 based on the derived target refrigerant temperature and the air volume of indoor unit. The controller 350 may derive the number of rotations of outdoor fan at which the coefficient of performance is maximized, and control the operation of the outdoor unit 100 based on the number of rotations of outdoor fan.

The air conditioner 10 may include a communication unit 320. The communication unit 310 may provide an interface for wired/wireless communication with at least one of the outdoor unit 100 and the indoor unit 200. For example, the communication unit 320 may transmit and receive signals using a short-distance wireless communication method such as Wi-Fi, Bluetooth, beacon, and zigbee.

The air conditioner 10 may include a storage unit 330. The storage unit 330 may store programs for processing and controlling each signal in the controller 350, or may store signal-processed image, audio, or data signals. For example, the storage unit 330 may store application programs designed for the purpose of performing various tasks that can be processed by the controller 350, and upon request from the controller 350, selectively provide some of the stored application programs.

The programs stored in the storage unit 330 are not particularly limited as long as they can be executed by the controller 350.

The storage unit 330 may include at least one of volatile memory (e.g. DRAM, SRAM, SDRAM, etc.), and non-volatile memory (e.g. flash memory, hard disk drive (HDD), solid state drive (SSD), etc.).

The controller 350 may receive various data (e.g., indoor temperature, indoor humidity, operation/stop time of the indoor unit, pipe temperature, refrigerant pressure, etc.) from the sensor unit 310, the outdoor unit 100, and at least one indoor unit 200 and store the received data in the storage unit 330.

The air conditioner 10 may include an input/output unit 340. The input/output unit 340 may receive various user commands related to the operation of the air conditioner 10, and transmit a control signal corresponding to the input command to the controller 350. The input/output unit 340 may include a display device such as a display (not shown), and a light emitting diode (LED) (not shown). The input/output unit 340 may display information such as an operating state related to an operating state, an error occurrence, or the like of the air conditioner 10, an indoor temperature, a target temperature, or the like.

The sensor unit 310, the communication unit 320, the storage unit 330, the input/output unit 340, and the controller 350 may be implemented as one independent control device 300. The control device 300 may be implemented in a mobile phone or smart phone, or controlled through a mobile phone or smart phone.

Figure 3:
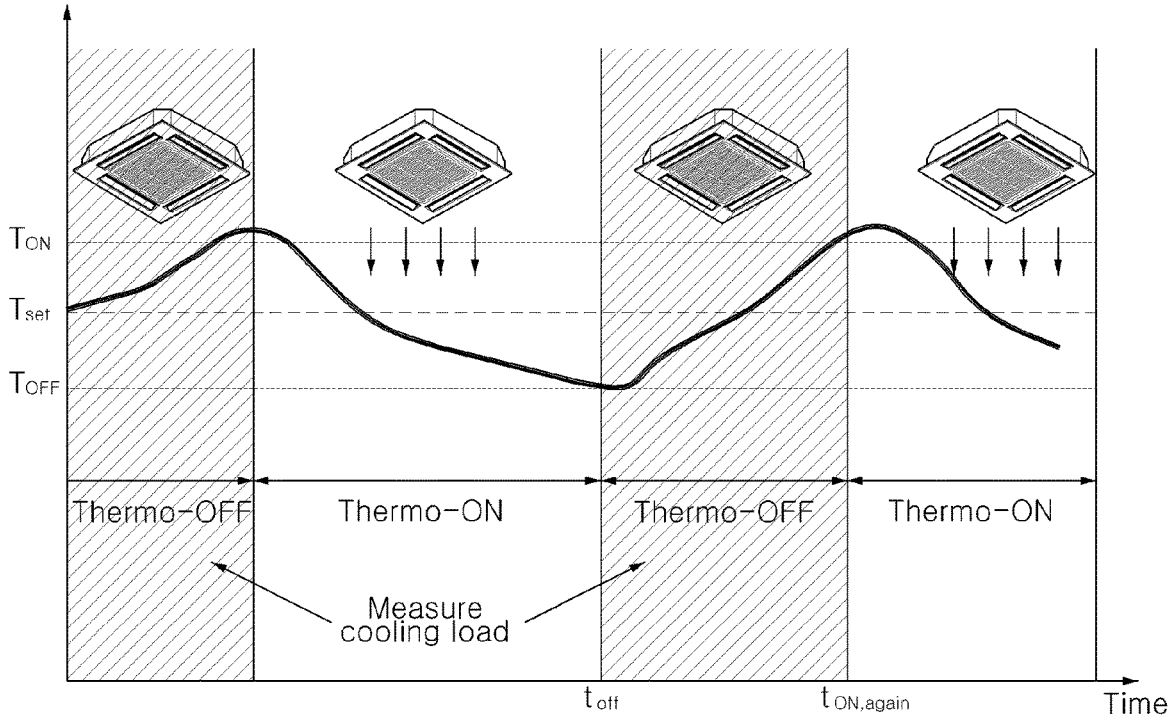
FIG. 3 is a diagram illustrating a change in the indoor temperature according to the operation (Thermo-ON) and operation stop (Thermo-OFF) of the air conditioner according to the present disclosure.

FIG. 3 is a diagram illustrating a change in the indoor temperature according to the operation (Thermo-ON) and operation stop (Thermo-OFF) of the air conditioner of the present disclosure, and FIGS. 4 to 7 are a flow chart illustrating the operation of the air conditioner of the present disclosure.

Figure 4:
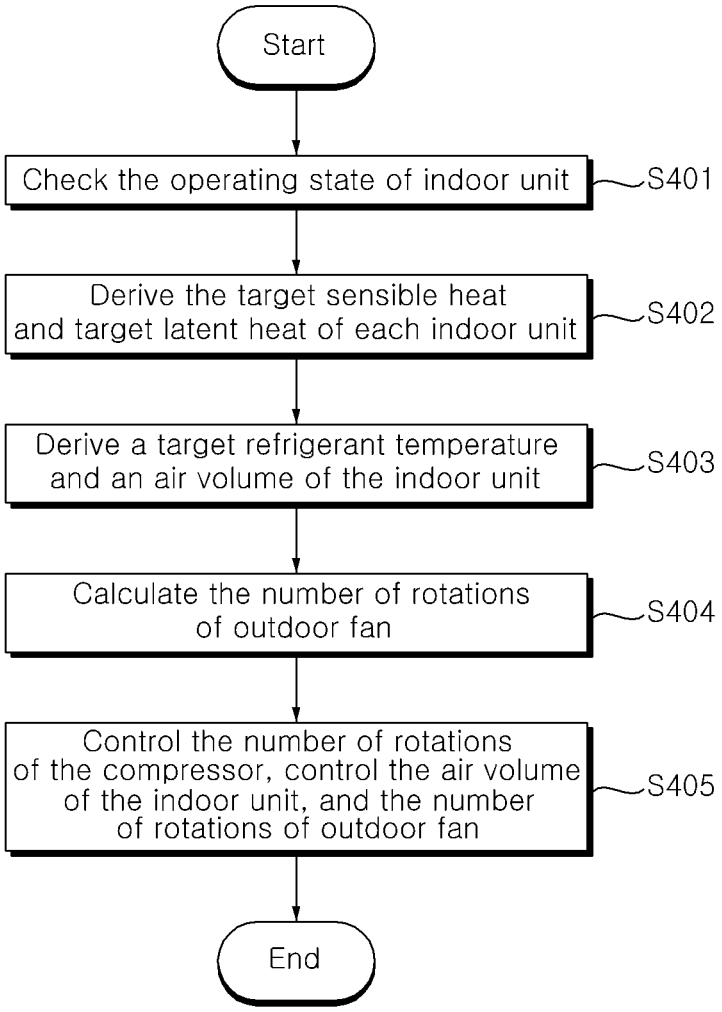
FIG. 4 is a flow chart illustrating the operation of the air conditioner of the present disclosure.

Referring to FIG. 4, the controller 350 may check the operating state of at least one indoor unit 200 (S401). The operating state may include the operation (Thermo-ON) and operation stop (Thermo-OFF) of the indoor unit 200.

The controller 350 may derive the target sensible heat and target latent heat of each indoor unit based on the indoor temperature and humidity of each indoor space where the indoor unit 200 is located at the time when the operation or operation stop of the indoor unit 200 occurs (S402).

The controller 350 may derive a target refrigerant temperature and an air volume of the indoor unit based on the derived target sensible heat and target latent heat (S403).

The controller 350 may calculate the number of rotations of outdoor fan at which the coefficient of performance (COP) is maximized (S404).

The controller 350 may control the number of rotations of the compressor according to the derived target refrigerant temperature, control the operation of the indoor unit 200 based on the derived air volume of the indoor unit, and control the operation of the outdoor unit 100 based on the derived number of rotations of outdoor fan (S405).

Figure 5:
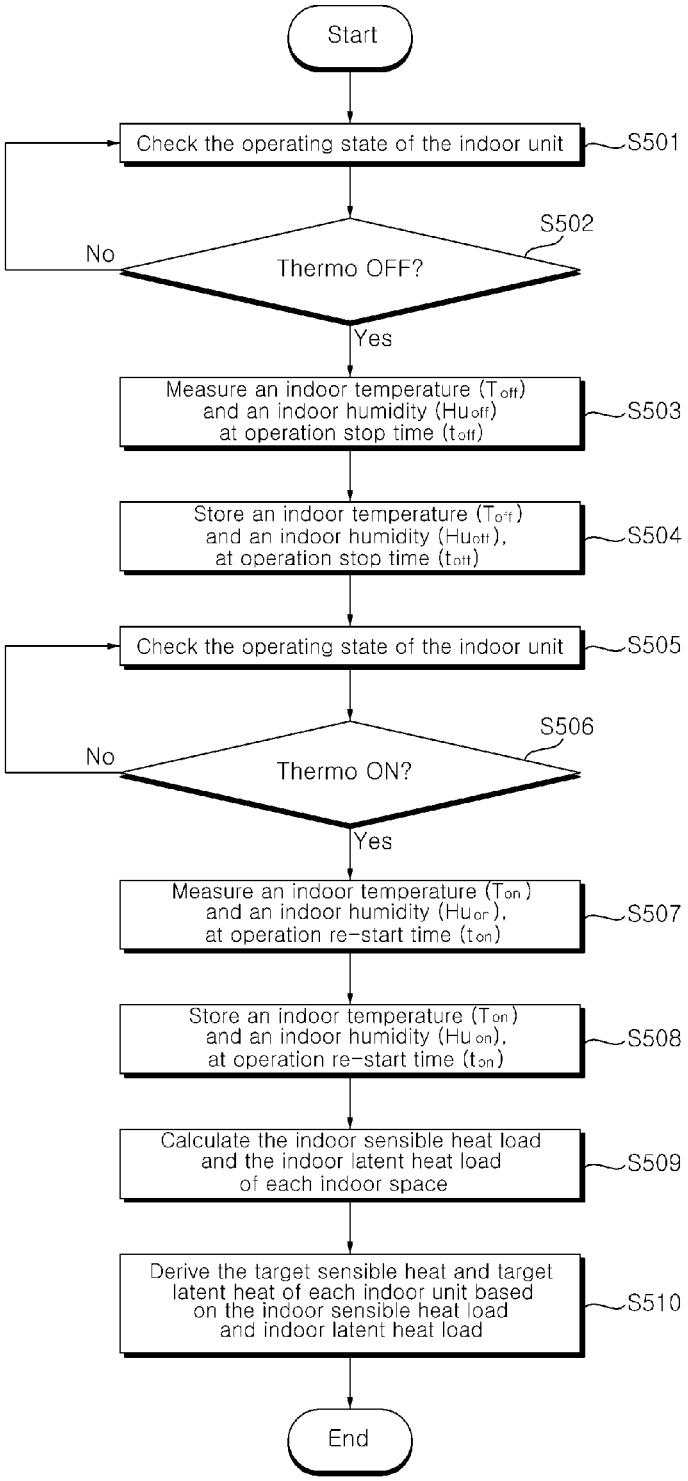
FIG. 5 is a flowchart illustrating an operation of deriving target sensible heat and target latent heat in the air conditioner of the present disclosure.

FIG. 5 is a flowchart showing a process (S402) of deriving target sensible heat and target latent heat of each indoor unit in FIG. 4 in detail.

Referring to FIGS. 3 and 5 together, the indoor unit 200 may cool/heat each indoor space in which the indoor unit 200 is located while repeating operation (Thermo-ON) and operation stop (Thermo-OFF). When the indoor unit 200 performs a cooling operation, the indoor temperature may continuously decrease (TON to TOFF) during the operation (Thermo-ON) of indoor unit 200, and the indoor temperature may continuously increase (TOFF to TON) during the operation stop (Thermo-OFF) of indoor unit 200. As the operation and operation stop of the indoor unit 200 are repeated, the temperature of each indoor space may be maintained near the target temperature.

The sensor unit 310 may be located in each indoor space where the indoor unit 200 is located. The sensor unit 310 may periodically measure the indoor temperature and the indoor humidity. The sensor unit 310 may measure and store a first indoor temperature TON and a first indoor humidity HuON in the storage unit 330 at a first time (toff) when the operation of the indoor unit 200 is stopped, and measure and store a second indoor temperature (TOFF) and a second indoor humidity (HuOFF) in the storage unit 330 at a second time (tON, again) when the operation starts again after the first time (S503, 504, 507, 508).

The controller 350 may check the operating state of the indoor unit 200 and check the operation stop state of indoor unit (S501, 502), and may derive the temperature change rate of each indoor space during the operation stop time, based on the first time (toff), the second time (tON, again), the first indoor temperature (TON), and the second indoor temperature (TOFF). The controller 350 may calculate the sensible heat load of each indoor space based on the temperature change rate and the volume of each indoor space (S509).

A sensible heat temperature equation denoting the sensible heat load of the indoor space may be expressed as Equation 1 below.

$$(MC_p)_{air}\frac{dT_{room}}{dt} = \dot{q}_{load,sens} - \dot{q}_{EHP,sens} \quad \text{[Equation 1]}$$

Since the heat quantity ($\dot{q}_{EHP,sens}$) of the indoor unit 200 is 0 at the time of Thermo-OFF when the cooling and heating operation of the indoor unit 200 is stopped, if the time up to the next operation Thermo-ON of the indoor unit 200 is measured, the sensible heat load ($\dot{q}_{load,sens}$) of the indoor space may be calculated as in Equation 2 below.

$$\dot{q}_{load,sens} = (MC_p)_{air}\frac{dT_{room}}{dt} \approx (\rho_{air}V_{room}C_{p,air})\left(\frac{T_{ON} - T_{OFF}}{t_{ON,again} - t_{OFF}}\right) \quad \text{[Equation 2]}$$

Here, $\rho_{air}$, $V_{room}$, $C_{p,air}$ denote density of air, volume of indoor space, and specific heat of air, respectively, TON denotes the first indoor temperature in the case of Thermo-ON, and TOFF denotes the second indoor temperature in the case of Thermo-OFF. In addition, tON, again means the second time when thermo-ON occurs again, and tOFF means the first time when thermo-OFF was previously occurred. Here, if the sensible heat load is positive, it becomes a cooling load, and if it is negative, it becomes a heating load.

As shown in Equation 2 above, the controller 350 may derive the temperature change rate of each indoor space from the first indoor temperature, the second indoor temperature, the first time, and the second time, and calculate the sensible heat load of each indoor space by multiplying the derived temperature change rate by the density of air in the indoor space, the volume of the indoor space, and the specific heat of air.

The controller 350 may derive the enthalpy change rate of each indoor space during the operation stop time based on the first time, the second time, the first indoor humidity, and the second indoor humidity, and may calculate the latent heat load of each indoor space based on the enthalpy change rate, and the volume and sensible heat load of each indoor space (S509).

The latent heat load may be calculated as shown in Equation 3 by measuring the enthalpy change rate of indoor air up to the next Thermo-ON based on the sensible heat load and the indoor humidity measured at the time of the thermo-OFF of indoor unit 200.

$$\dot{q}_{load,lat} = M_{air}\frac{dh_{room}}{dt} - \dot{q}_{load,sens} \approx (\rho_{air}V_{room})\left(\frac{h_{ON} - h_{OFF}}{t_{ON,again} - t_{OFF}}\right) - \dot{q}_{load,sens} \quad \text{[Equation 3]}$$

Here, $\dot{q}_{load,lat}$ denotes the latent heat load, $\dot{q}_{load,sens}$ denotes the sensible heat load, and $h_{ON}$ and $h_{OFF}$ denote the enthalpy of indoor air at the second time and the first time, respectively.

The controller 350 may derive the enthalpy change rate by dividing a difference between the enthalpy at the second time and the enthalpy at the first time by a difference between the second time and the first time, and may calculate the latent heat load by subtracting the sensible heat load from a value obtained by multiplying the enthalpy change rate by the density of air and the volume of the indoor space.

The controller 350 may derive the target sensible heat and the target latent heat of each indoor unit based on the calculated sensible heat load and latent heat load (S510).

The controller 350 may set the target sensible heat to be greater than the sensible heat load by a preset ratio, and set the target latent heat to be greater than the latent heat load by a preset ratio.

For example, as shown in Equation 4 below, the controller 350 may set the target sensible heat and the target latent heat to be 30% greater than the sensible heat load and the latent heat load, respectively.

$$\dot{q}_{sens,targ}=1.3\dot{q}_{load,sens}, \dot{q}_{lat,targ}=1.3\dot{q}_{lat,sens} \quad \text{[Equation 4]}$$

Here, $\dot{q}_{sens,targ}$ denotes the target sensible heat, and $\dot{q}_{lat,targ}$ denotes the target latent heat.

Ideal load-matching control achieves a cooling/heating capacity equal to the calculated sensible heat load and latent heat load. However, when the controller 350 sets the target cooling/heating capacity of the indoor unit 200 to be greater than the load, it is possible to prevent a phenomenon in which cooling/heating is weakened.

Accordingly, the air conditioner of the present disclosure may measure the indoor temperature and the indoor humidity at the time of operation and operation stop of the indoor unit, and calculate the sensible heat load and the latent heat load of the indoor space based on the measurement, thereby increasing the accuracy of the indoor space load matching.

Figure 6:
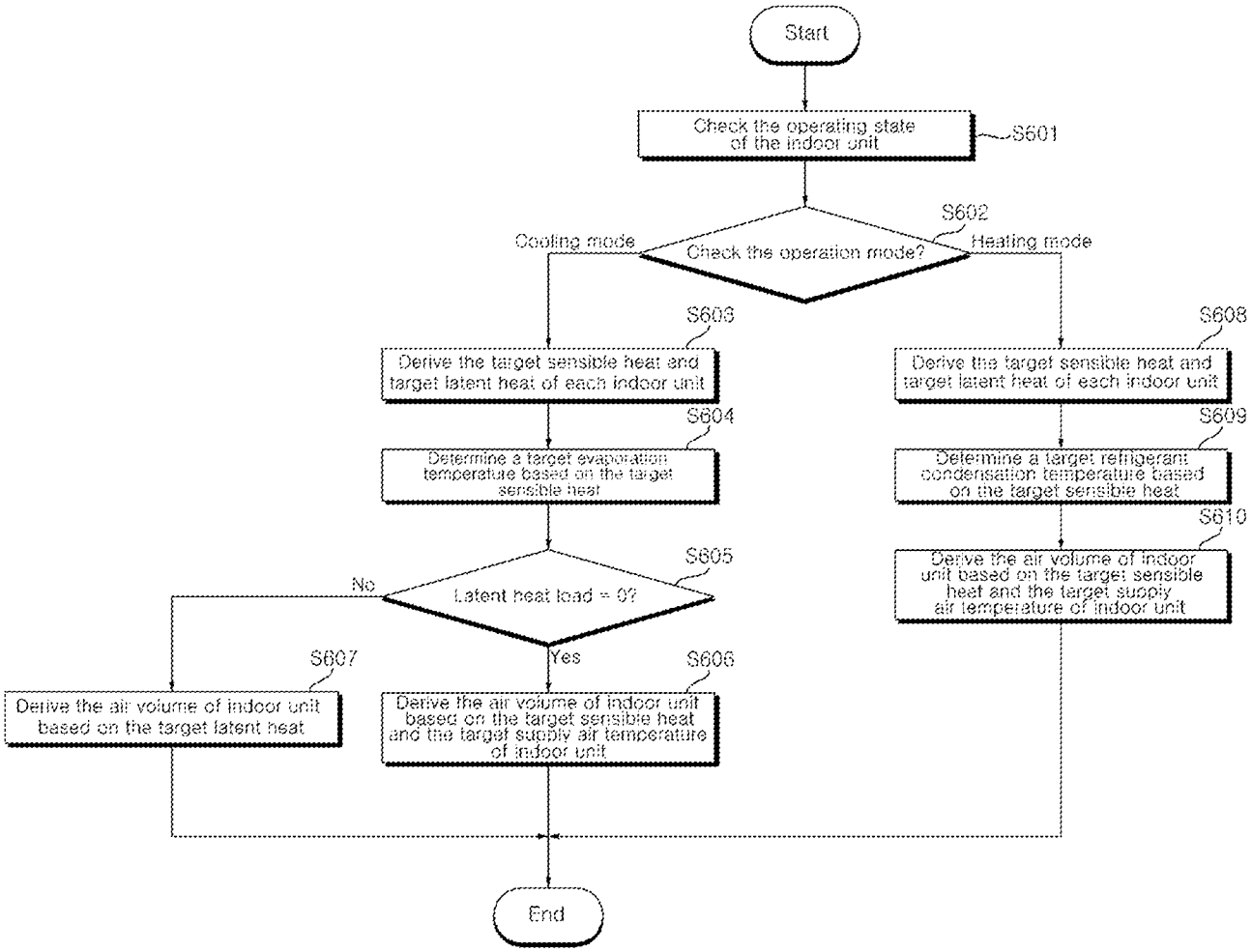
FIG. 6 is a flowchart illustrating an operation of deriving a target evaporation temperature and an air volume of an indoor unit in the air conditioner of the present disclosure.

FIG. 6 is a flowchart showing the process (S403) of deriving the target refrigerant temperature and the air volume of each indoor unit in FIG. 4 in detail.

Referring to FIG. 6, the controller 350 may derive a target refrigerant temperature and an air volume of the indoor unit 200 based on target sensible heat and target latent heat.

The controller 350 may check the operating state of the indoor unit, and check the operation mode (S601, 602).

The controller 350 may determine a target refrigerant temperature based on the target sensible heat. The target refrigerant temperature may be determined further based on the number of indoor units, a ratio of rated cooling/heating capacity of each indoor unit, sensible heat exchange effectiveness, an air mass flow of the indoor unit, and an indoor temperature.

When the operation mode is the cooling mode, the controller 350 may determine a target evaporation temperature based on the target sensible heat (S604). When the operation mode is the heating mode, the controller 350 may determine the target condensation temperature based on the target sensible heat (S609).

The target refrigerant temperature may be determined based on the sensible heat load or the target sensible heat, as shown in Equation 5 below.

$$T_{eva} = T_{ind} - \frac{\dot{q}_{sens,targ}}{\varepsilon_s(\dot{m}_{air}C_{p,air})}, \quad \text{[Equation 5]}$$

Here, $T_{ind}$ denotes the indoor temperature, $\varepsilon_s$ denotes the sensible heat exchange effectiveness, and $\dot{m}_{air}$ denotes the mass flow of air in the indoor unit. The target refrigerant temperature becomes a target evaporation temperature in the cooling mode, and becomes a target condensation temperature in the heating mode. When the target refrigerant temperature is derived, the controller 350 may further determine the number of rotations (Hz) of compressor so as to follow the target refrigerant temperature. In the case of the heating mode in which the load becomes negative in Equation 5, $T_{eva}$ (target evaporation temperature) is changed to Tcond (target condensation temperature).

Equation 5 above shows the target refrigerant temperature when there is a single indoor unit, and when there are a plurality of indoor units, the target refrigerant temperature may be expressed as in Equation 6 below.

$$T_{eva} = \frac{1}{N}\sum_{J=1}^{N}\omega_J T_{ind} - \frac{\frac{1}{N}\sum_{J=1}^{N}\omega_J \dot{q}_{Jsens,targ}}{\varepsilon_s\left(\frac{1}{N}\sum_{J=1}^{N}\dot{m}_{J,air}C_{p,air}\right)}, \quad \text{[Equation 6]}$$

Here, N is the number of indoor units and ωJ is the ratio of the rated cooling/heating capacity of each indoor unit. Subscript J means numeral of each indoor unit. In the case of the heating mode in which the load is negative in Equation 6, $T_{eva}$ (target evaporation temperature) is changed to Tcond (target condensation temperature).

As shown in Equation 5, the controller 350 may divide the target sensible heat by a value obtained by multiplying the sensible heat exchange effectiveness, the mass flow of the air in the indoor unit, and the specific heat of the air, and subtracts it from the indoor temperature to derive the target refrigerant temperature.

In addition, as shown in Equation 6 above, the controller 350 may derive the target refrigerant temperature by further considering the ratio of the number of indoor units and the rated cooling/heating capacity of each indoor unit, with respect to the plurality of indoor units.

The controller 350 may determine the number of rotations of the compressor based on the derived target refrigerant temperature. Since it is obvious to those skilled in the art to determine the number of rotations of the compressor to follow the target refrigerant temperature, a detailed description is omitted in the present disclosure.

The controller 350 may determine the operation mode, and when the operation mode is the cooling mode, if the latent heat load is 0, derive the air volume of the indoor unit based on the target sensible heat and the target supply air temperature of the indoor unit, and if the latent heat load is positive, derive the air volume of the indoor unit based on the target latent heat (S605, 606, 607).

When the operation mode is the heating mode, the controller 350 may derive the air volume of the indoor unit based on the target sensible heat and the target supply air temperature of the indoor unit (S610).

The controller 350 may derive the air volume of the indoor unit as shown in Equation 7 below.

$$\dot{m}_{J_{air}} = \begin{cases} \dfrac{\dot{q}_{J_{lat,targ}}}{\varepsilon_l(\omega_{in} - \omega_{sat})\Delta H_{J,lat}}\left(\text{if } \dot{q}_{J_{lat,targ}} > 0\right), \\ \dfrac{\dot{q}_{J_{sense,targ}}}{C_{p,air}\left(T_{dis,targ} - T_{J,ind}\right)}\left(\text{if } \dot{q}_{J_{lat,targ}} \le 0\right) \end{cases} \quad \text{[Equation 7]}$$

Here, $T_{dis,targ}$ is the target supply air temperature of the indoor unit. $\omega_{in}$ and $\omega_{sat}$ are the intake air and the specific humidity at saturation, and $H_{J,lat}$ is the specific heat of wet air, which is given as a function of temperature. $\varepsilon_l$ is the latent heat exchange effectiveness. In addition, the air volume of the indoor unit can be considered as the same concept as the mass flow of air in the indoor unit.

In the case of the heating mode, since the target latent heat ($\dot{q}_{J\ lat,targ}$) of each indoor unit is a negative number, the lower formula of the Equation 7 is applied. That is, when the operation mode is the heating mode, the controller 350 may divide the target sensible heat of each indoor unit by a value obtained by multiplying the specific heat of air by a value obtained by subtracting the indoor temperature of each indoor space from the target supply air temperature of the indoor unit, thereby deriving the air volume of the indoor unit.

In the case of the cooling mode, the target latent heat of each indoor unit may be 0 or more. If the target latent heat (or latent heat load) is 0, the lower formula of the Equation 7 is applied. That is, when the operation mode is the cooling mode and the latent heat load is 0, the controller 350 may divide the target sensible heat of each indoor unit by a value obtained by multiplying the specific heat of air by a value obtained by subtracting the indoor temperature of each indoor space from the target supply air temperature of the indoor unit, thereby deriving the air volume of the indoor unit.

If the target latent heat (or latent heat load) is a positive number, the upper formula of the Equation 7 is applied. That is, when the operation mode is the cooling mode and the latent heat load is a positive number, the controller 350 may derive the air volume of the indoor unit by dividing the target latent heat of each indoor unit by a value obtained by multiplying the latent heat exchange effectiveness and the wet air specific heat by a difference between the specific humidity of the intake air and the specific humidity at saturation.

In comparison with the maximum temperature difference that can be obtained from heat exchange between two fluids having different temperatures, the exchange effectiveness of sensible heat and latent heat is given as the ratio of the temperature difference before and after heat transfer that can be obtained by a fluid having a small actual heat capacity, and has a value of 0 to 1. In the heat exchange between air and refrigerant, since most of the refrigerant has a phase change of condensation or evaporation, the temperature hardly changes, so that the air has a relatively small heat capacity, and the air side has a temperature difference caused by heat transfer. Therefore, the sensible heat exchange effectiveness and the latent heat exchange effectiveness can be expressed as in Equation 8 below.

If the Lewis number, which is the ratio of heat transfer and mass transfer, is set to 1, that is, assuming perfect similarity between heat transfer and mass transfer, the latent heat exchange effectiveness is equal to the sensible heat exchange effectiveness.

$$\varepsilon_s \equiv 1 - \exp\left(-\frac{UA}{\dot{m}C_{p,air}}\right),\ \frac{1}{UA} = \frac{1}{h_r A_r} + \frac{1}{\eta h_{air} A_{air}} \quad \text{[Equation 8]}$$

$$\varepsilon_l \equiv 1 - \exp\left(-\frac{UA}{\dot{m}C_{p,air}Le^{2/3}}\right) = \varepsilon_s(\because Le = 1)$$

Here, $h_r$ and $h_{air}$ are heat transfer coefficients of the refrigerant side and the air side, and η is the efficiency of the fin. These values may be obtained analytically or experimentally, or derived by using theoretical correlations from existing studies.

Accordingly, the air conditioner of the present disclosure may increase cooling/heating efficiency of the air conditioner by determining a target refrigerant temperature and an air volume of an indoor unit based on the calculated sensible heat load and latent heat load.

Figure 7:
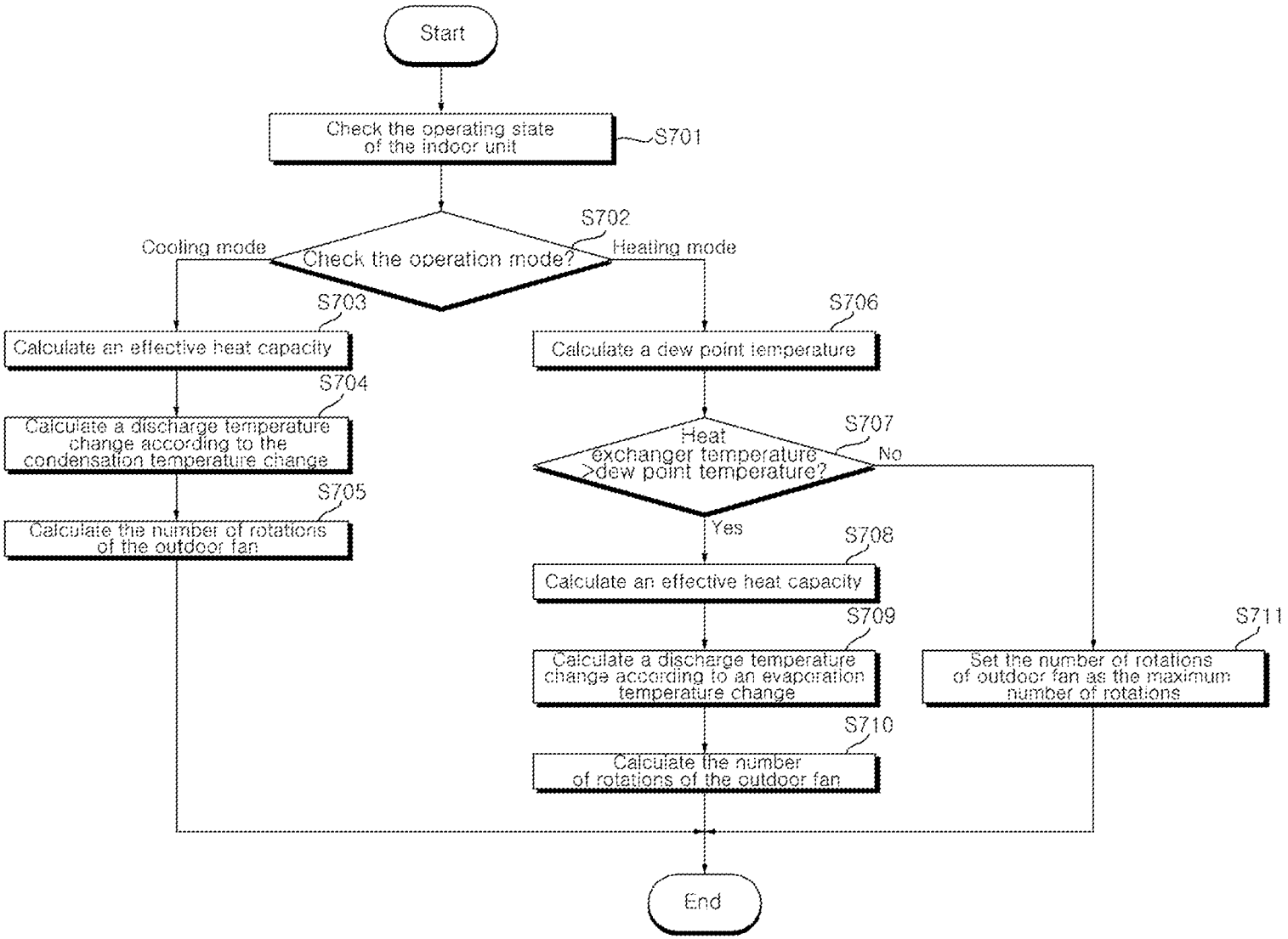
FIG. 7 is a flowchart illustrating an operation of calculating the number of rotations of an outdoor fan in the air conditioner of the present disclosure.

FIG. 7 is a flowchart showing the process (S404) of calculating the number of rotations of outdoor fan in FIG. 4 in detail.

Referring to FIG. 7, the controller 350 may derive a target refrigerant temperature and air volume of the indoor unit 200 based on target sensible heat and target latent heat.

The controller 350 may derive the number of rotations of outdoor fan at which the coefficient of performance is maximized.

Here, the coefficient of performance (COP) is a value obtained by dividing the heating/cooling capacity by a total power consumption, and the total power consumption is a value obtained by adding the power consumptions of the compressor, the indoor fan, and the outdoor fan.

The controller 350 may derive the number of rotations of outdoor fan from the number of rotations satisfying a condition in which the change rate in the total power consumption due to the change in the number of rotations of outdoor fan is zero.

The controller 350 may determine the operation mode, calculate an effective heat capacity when the operation mode is the cooling mode, calculate a discharge temperature change rate according to the condensation temperature change, and derive the number of rotations of the outdoor fan by applying the calculated effective heat capacity and the calculated discharge temperature change rate according to the condensation temperature change to the condition in which the change rate in the total power consumption due to the number of rotations of outdoor fan is zero (S703, 704, 705).

When the indoor unit 200 is in a cooling operation, an object for deriving the optimal number of rotations of fan is a coefficient of performance (COP). The coefficient of performance during cooling operation is defined as in Equation 9 below.

$$COP = \frac{\dot{Q}_e}{\dot{W}_{Comp} + \dot{W}_{ODF} + \dot{W}_{IDF}} \quad \text{[Equation 9]}$$

Here, $\dot{Q}_e$ denotes the cooling capacity, and $\dot{W}_{Comp}$, $\dot{W}_{ODF}$, and $\dot{W}_{IDF}$ denotes the power consumptions of the compressor, outdoor fan, and indoor fan, respectively.

Assuming that the performance of the indoor unit before and after controlling the number of rotations of outdoor fan is the same, and assuming the independence of the indoor fan control, the condition for maximizing the coefficient of performance is expressed by Equation 10 below.

$$\frac{\partial COP}{\partial \varphi} = 0 \rightarrow \frac{\partial \dot{W}_{Comp}}{\partial \varphi} + \frac{\partial \dot{W}_{ODF}}{\partial \varphi} = 0 \quad \text{[Equation 10]}$$

Here, $\varphi$ denotes the number of rotations (RPM) of the outdoor fan. The power consumption of the compressor and the power consumption of the fan are modeled as Equations 11 and 12 below from a compressor general model and a fan-power theory.

$$\dot{W}_{Comp} = \frac{\dot{m}_{ref}}{\eta_c}(h_{disc} - h_{suc}) = \frac{\eta_v}{\eta_c}\rho_s V_d \phi\left(h_{c,s} + \overline{C_{p,s}}\Delta T_{dsh} - h_{e,s} - \overline{C_{p,s}}\Delta T_{sh}\right) \quad \text{[Equation 11]}$$

$$\dot{W}_{ODF} = \left(\frac{W_{ODF\ 0}}{\varphi_0^3}\right)\varphi^3 \quad \text{[Equation 12]}$$

Here, $\eta_v$ denotes a compressor volumetric efficiency, $\eta_c$ denotes a value obtained by multiplying a compressor mechanical efficiency by a polytropic efficiency, $\dot{m}_{ref}$ denotes a refrigerant circulation amount, $\rho_s$ denotes a compressor suction refrigerant density, $V_d$ denotes a compressor exclusion volume, $\phi$ denotes the number of rotations of compressor, $\overline{C_{p,d}}$ and $\overline{C_{p,s}}$ denote an average constant pressure specific heat of the discharge and suction refrigerants, $h_{c,s}$ and $h_{e,s}$ denote a specific enthalpy of the condensation and evaporation temperature saturated steam, $\Delta T_{dsh}$ denotes a discharge superheat of refrigerant, $\Delta T_{sh}$ denotes a suction superheat of refrigerant, $W_{ODF\ 0}$ denotes a fan power consumption at the number of rotations of reference fan, and $\varphi_0$ denotes the number of rotations of reference fan.

Substituting Equations 11 and 12 into Equation 10 can be expressed as Equation 13 below.

$$\frac{\eta_V}{\eta_c}\rho_s V_d \phi C_{eq}\left(\frac{\partial T_c}{\partial \varphi}\right) + \left(\frac{3W_{ODF\ 0}}{\varphi_0^3}\right)\varphi^2 = 0 \quad \text{[Equation 13]}$$

Here, $C_{eq}$ is the effective heat capacity, and is a value obtained by partial differentiating a difference between the discharge enthalpy and the suction enthalpy by the condensation temperature.

The controller 350 may calculate the effective heat capacity. The condensation temperature change $\partial T_c/\partial\varphi$ due to an effective heat capacity $C_{eq}$ and a change in the number of rotations of fan may be derived as shown in Equations 14 and 15 below.

$$C_{eq} = \frac{\partial}{\partial T_c}\left(h_{c,s} + \overline{C_{p,d}}\Delta T_{dsh} - h_{e,s} - \overline{C_{p,s}}\Delta T_{sh}\right) \approx (288.2 + 8.62T_c) + \overline{C_{p,d}}\frac{\partial T_{dis}}{\partial T_c} - \overline{C_{p,s}} \quad \text{[Equation 14]}$$

$$\frac{\partial T_c}{\partial \varphi} = \frac{\varepsilon_c\left(\frac{\rho_{air}\dot{V}_{a0}}{\varphi_0}\right)C_{p,air}(T_{OD} - T_C)}{\varepsilon_c\left(\frac{\rho_{air}\dot{V}_{a0}}{\varphi_0}\right)C_{p,air}\varphi - \frac{\eta_V}{\eta_c}\rho_s V_d C_{eq}\phi} \quad \text{[Equation 15]}$$

Here, $\varepsilon_c$ is the air-refrigerant heat exchange effectiveness in the condenser, $\dot{V}_{a0}$ is the air volume of outdoor fan at the number of rotations of reference fan, and $T_{OD}$ is the temperature of the outdoor air.

The controller 350 may calculate a discharge temperature change according to a condensation temperature change. The discharge temperature change $\partial T_{dis}/\partial_c$ according to the condensation temperature change is defined as in Equation 16 below.

$$\frac{\partial T_{dis}}{\partial T_c} = \frac{\partial}{\partial T_c}\left[T_{suc}\left(\frac{p_c}{p_e}\right)^{\frac{n-1}{n}}\right] \approx \quad \text{[Equation 16]}$$

-continued $$\left(\frac{n-1}{n}\right)p_c^{-\frac{1}{n}}p_e^{\frac{1-n}{n}}T_{suc}\begin{pmatrix}25164+612.6T_c+\\5.85T_c^2\end{pmatrix}$$

The controller 350 may derive the number of rotations of outdoor fan by applying the calculated effective heat capacity and the calculated discharge temperature change rate according to the condensation temperature change to the condition in which the change rate in the total power consumption due to the number of rotations of outdoor fan is zero.

That is, if the number of rotations of outdoor fan is derived by substituting Equations 14 to 16 into Equation 13, the number of rotations of outdoor fan can be derived as shown in Equation 17 below.

$$\left[\begin{array}{l} b=-\dfrac{\eta_v\rho_2V_d\varphi C_{eq}\phi_0}{\eta_c\varepsilon_2\rho_{air}\dot{V}_{a0}C_{p,air}},\\ d=\dfrac{\phi_0^3\eta_v\rho_sV_d\varphi C_{eq}(T_{OD}-T_c)}{3\eta_cW_{ODF,0}}\end{array}\right] \quad \text{[Equation 17]}$$

The controller 350 may determine the operation mode and, when the operation mode is the heating mode, calculate a dew point temperature (S706). When the calculated dew point temperature is higher than the heat exchanger temperature, the controller 350 may determine the number of rotations of outdoor fan as a maximum number of rotations (S710).

When the calculated dew point temperature is lower than the heat exchanger temperature, the controller 350 may calculate an effective heat capacity and calculate a discharge temperature change rate according to a evaporation temperature change (S707, 708).

The controller 350 may derive the number of rotations of outdoor fan by applying the calculated effective heat capacity and the calculated discharge temperature change rate according to the condensation temperature change to the condition in which the change rate in the total power consumption due to the number of rotations of outdoor fan is zero (S709).

The coefficient of performance in heating operation is defined as in Equation 18 below.

$$COP=\frac{\dot{Q}_c}{\dot{W}_{Comp}+\dot{W}_{ODF}+\dot{W}_{IDF}} \quad \text{[Equation 18]}$$

Here, $\dot{Q}_c$ denotes the heating capacity. The condition for maximizing the coefficient of performance is shown in Equation 19 below.

$$\frac{\eta_v}{\eta_c}\rho_sV_d\phi\left(\Delta h\frac{\partial\rho_s}{\partial T_e}+\rho_s\frac{\partial\Delta h}{\partial T_e}\right)\left(\frac{\partial T_e}{\partial\varphi}\right)+\left(\frac{3W_{ODF\,0}}{\varphi_0^3}\right)\varphi^2=0 \quad \text{[Equation 19]}$$

Here, Δh denotes a difference between a compressor discharge enthalpy and a suction enthalpy, and $$\overline{\rho C}_{eq}\equiv\Delta h\frac{\partial\rho_s}{\partial T_e}+\rho_s\frac{\partial\Delta h}{\partial T_e}$$

denotes the effective heat capacity.

The controller 350 may calculate an effective heat capacity. Here, the effective heat capacity is a value obtained by partial differentiating a difference between a discharge enthalpy and a suction enthalpy by the evaporation temperature.

The evaporation temperature change $\partial T_c/\partial\varphi$ due to an effective heat capacity and a change in the number of rotations of fan can be derived as shown in Equations 20 and 21 below.

$$\begin{aligned}\overline{\rho C}_{eq}&=\Delta h\frac{\partial\rho_s}{\partial T_e}+\rho_s\frac{\partial\Delta h}{\partial T_e}\approx\\&\left\{\begin{matrix}288.2(T_c-T_e)-4.31(T_c^2-T_e^2)+\\\overline{C_{p,d}}\Delta T_{dsh}-\overline{C_{p,s}}\Delta T_{sh}\end{matrix}\right\}\left(\frac{\rho_{s,Te2}-\rho_{s,Te1}}{T_{e2}-T_{e1}}\right)+\\&\rho_s\left(8.62T_e-288.2+C_{p,d}\frac{\partial T_{dis}}{\partial T_e}\right)\end{aligned} \quad \text{[Equation 20]}$$

$$\frac{\partial T_e}{\partial\varphi}=\frac{\rho_{air}\dot{V}_{a0}[\varepsilon_sC_{p,a}(T_{OD}-T_e)+\varepsilon_l(\omega_{OD}-\omega_p)H_{lat}]}{\rho_{air}\dot{V}_{a0}\left[\varepsilon_sC_{p,a}+\varepsilon_lH_{lat}\left(\frac{\partial\omega}{\partial T_e}\right)\right]\varphi+\frac{\eta_v}{\eta_c}V_d\varphi_0\phi\overline{\rho C}_{eq}} \quad \text{[Equation 21]}$$

The controller 350 may calculate a discharge temperature change rate according to a evaporation temperature change. The discharge temperature change rate according to the evaporation temperature change is defined as in Equation 22 below.

$$\begin{aligned}\frac{\partial T_{dis}}{\partial T_e}&=\left[1-\left(\frac{T_{suc}}{p_e}\right)\left(\frac{n-1}{n}\right)\left(\frac{\partial p_e}{\partial T_e}\right)\right]\left(\frac{p_c}{p_e}\right)^{\frac{n-1}{n}}\\&\approx\left[1-\left(\frac{T_{suc}}{p_e}\right)\left(\frac{n-1}{n}\right)\begin{pmatrix}25165+613T_e+\\5.9T_e^2\end{pmatrix}\right]\left(\frac{p_c}{p_e}\right)^{\frac{n-1}{n}}\end{aligned} \quad \text{[Equation 22]}$$

When the calculated dew point temperature is lower than the heat exchanger temperature, the controller 350 may derive the number of rotations of the outdoor fan by applying the calculated effective heat capacity and the calculated discharge temperature change rate according to the condensation temperature change to the condition in which the change rate in the total power consumption due to the number of rotations of outdoor fan is zero. That is, when the number of rotations of outdoor fan is derived by substituting Equations 20 to 22 into Equation 19, the number of rotations of outdoor fan can be derived as shown in Equation 23 below.

$$\begin{aligned}b&=\frac{\frac{\eta_v}{\eta_c}V_d\phi\overline{\rho C}_{eq}\varphi_0}{\rho_{air}\dot{V}_{a0}\left(\varepsilon_sC_{p,a}+\varepsilon_l\frac{\partial\omega}{\partial T_e}H_{lat}\right)},\\d&=\frac{\left[\begin{matrix}\left(\frac{\varphi_0^3}{3W_{ODF\,0}}\right)\frac{\eta_v}{\eta_c}V_d\phi\overline{\rho C}_{eq}\rho_{air}\dot{V}_{a0}\times\\\{\varepsilon_sC_{p,a}(T_{OD}-T_e)+\varepsilon_l(\omega_{OD}-\omega_p)H_{lat}\}\end{matrix}\right]}{\rho_{air}\dot{V}_{a0}\left(\varepsilon_sC_{p,a}+\varepsilon_l\frac{\partial\omega}{\partial T_e}H_{lat}\right)}\end{aligned} \quad \text{[Equation 23]}$$

Here, ω is a specific humidity, and the specific humidity can be calculated based on a relative humidity and an absolute temperature of air.

When the calculated dew point temperature is higher than the temperature of the heat exchanger, the controller 350 may determine the number of rotations of outdoor fan as the maximum number of rotations. In the case of heating mode, if the pipe temperature is below zero and lower than the dew point temperature, the outdoor fan can be controlled to operate at the maximum number of rotations regardless of the above results. Accordingly, it may be possible to prevent defrost in the heating mode.

Accordingly, the air conditioner of the present disclosure can maximize the efficiency of the air conditioner by calculating the rotational speed of the outdoor fan at which the coefficient of performance is maximized.

Figure 8:
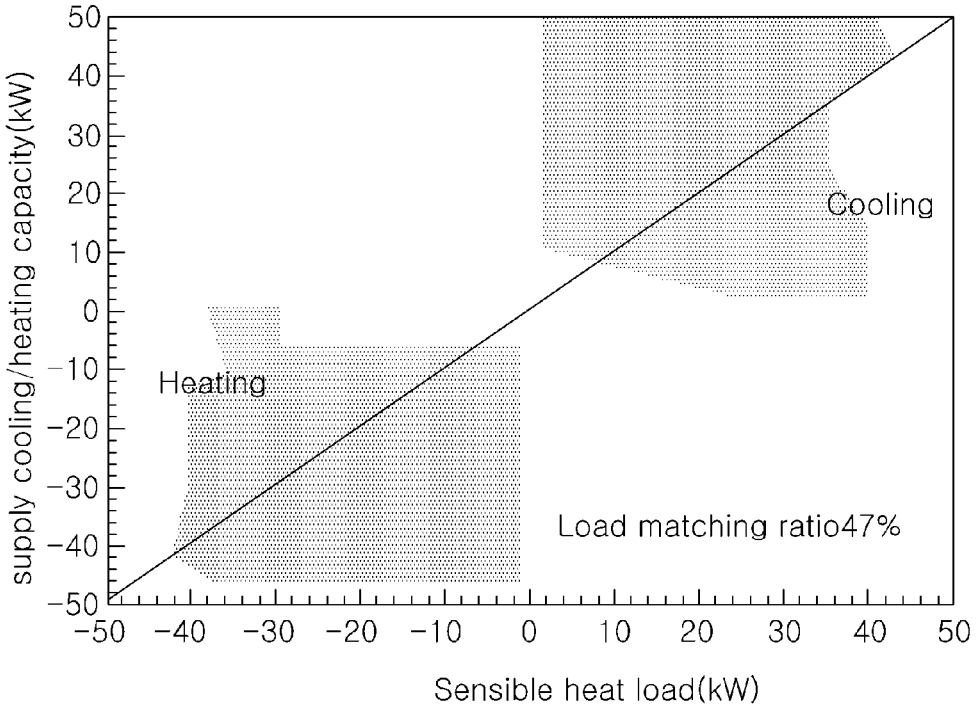
FIGS. 8 (*a*) and (*b*) are graphs comparing the load matching rate of the air conditioner of the present disclosure with the load matching rate of a conventional air conditioner.
Figure 8:
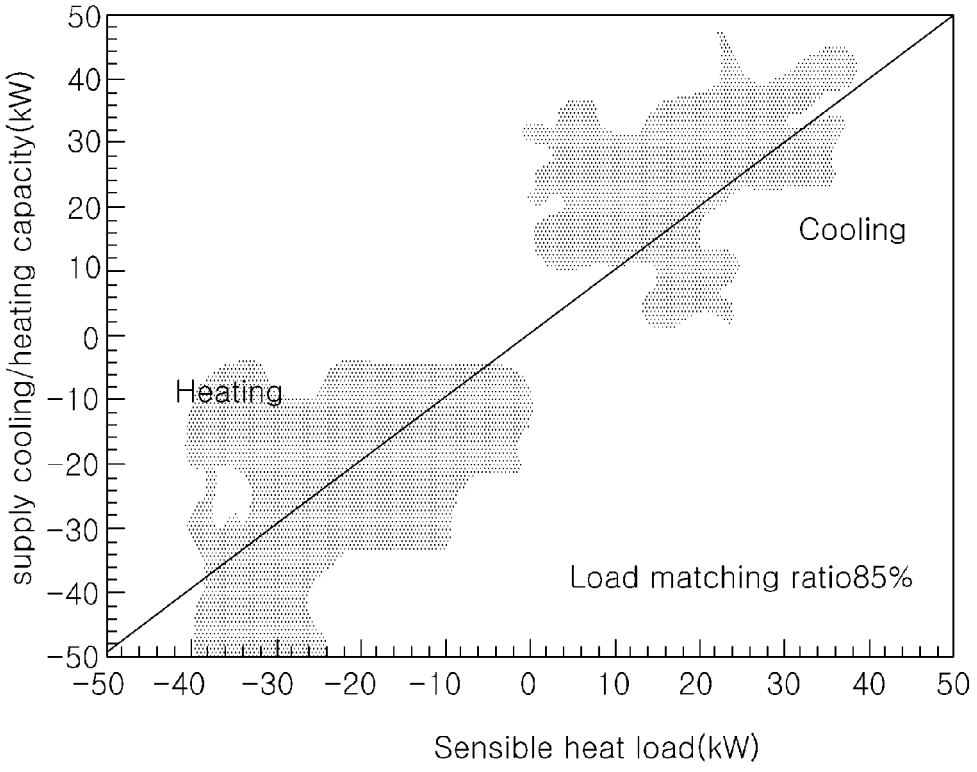
Figure 9:
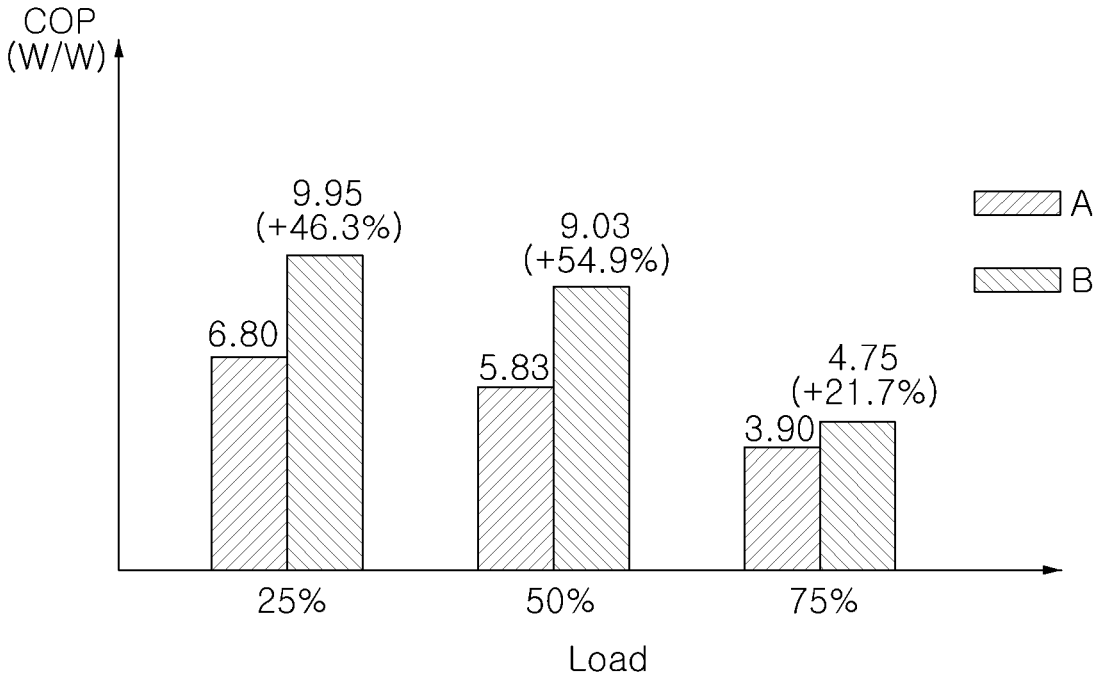
FIG. 9 is a graph comparing the coefficient of performance of the air conditioner of the present disclosure with that of a conventional air conditioner.
Figure 10:
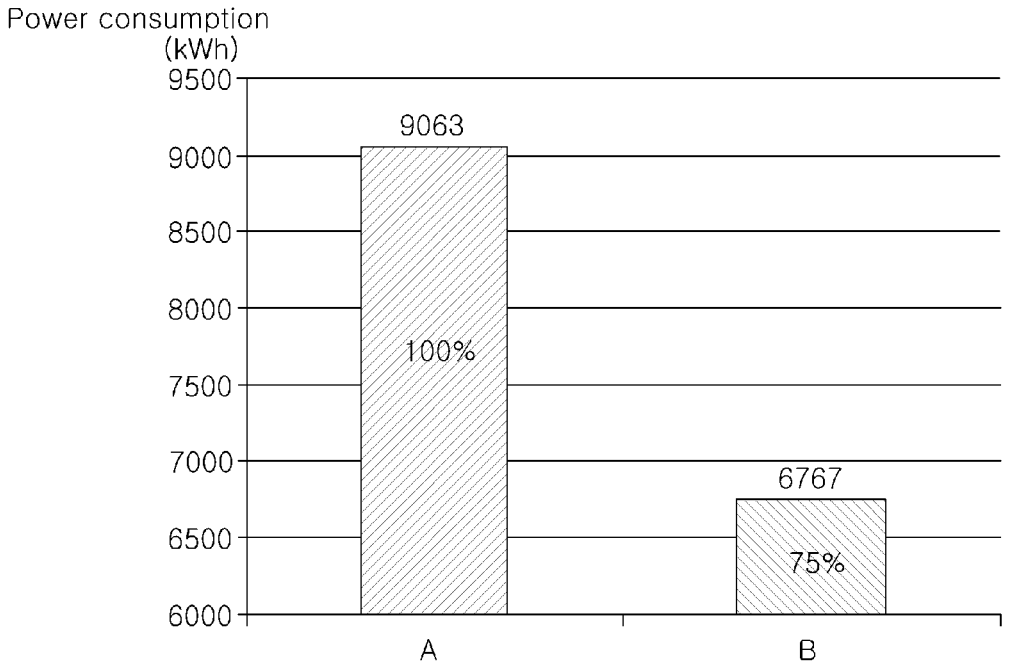
FIG. 10 is a graph comparing the power consumption of the air conditioner of the present disclosure with the power consumption of a conventional air conditioner.

FIG. 8 is a graph comparing the load matching rate of the air conditioner of the present disclosure with the load matching rate of a conventional air conditioner. FIG. 9 is a graph comparing the coefficient of performance of the air conditioner of the present disclosure with that of a conventional air conditioner. FIG. 10 is a graph comparing the one-year integrated power consumption of the air conditioner of the present disclosure with the one-year integrated power consumption of a conventional air conditioner.

In FIG. 8, the horizontal axis indicates the sensible heat load of the indoor space, and the vertical axis indicates a corresponding cooling/heating capacity of the indoor unit. In a graph, it can be interpreted that the load matching ratio becomes higher as the cooling/heating capacity value of the indoor unit according to the sensible heat load is closer to a diagonal line between the horizontal axis and the vertical axis of the graph.

In the case of the air conditioner 10 of the present disclosure (FIG. 8B), in comparison with the case of the conventional air conditioner (FIG. 8A), it can be seen that the cooling/heating capacity of the indoor unit in the cooling and heating mode is matched similarly to the sensible heat load.

Table 1 below is a chart comparing the coefficient of performance of the air conditioner of the present disclosure with that of a conventional air conditioner. Table 1 shows comparison results measured in a multi-air conditioner system in which eight indoor units are connected to one outdoor unit. In the comparative experiment, the number of rotations of the compressor is manually set in the cooling mode of 25%, 50%, and 75% of the load, and only the outdoor fan is set to be operated automatically. The number of rotations of an outdoor fan, cooling capacity, power consumption, and coefficient of performance (COP) of the existing pressure tracking logic and the logic of the present disclosure are shown.

one-year integrated power consumption A of the conventional air conditioner. This is because the accuracy of load matching of the air conditioner 10 of the present disclosure is high and the coefficient of performance is higher, as shown in FIGS. 8 and 9.

As shown in FIGS. 8 to 10, the air conditioner 10 of the present disclosure may measure the indoor temperature and indoor humidity at the time of operation and operation stop of the indoor unit, and based on the measurement, calculate the sensible heat load and latent heat load of the indoor space to enhance the accuracy of indoor space load matching, determine the target refrigerant temperature and air volume of the indoor unit based on the calculated sensible heat load and latent heat load to increase the cooling/heating efficiency of the air conditioner, and may maximize the efficiency of the air conditioner by calculating the rotational speed of the outdoor fan at which the coefficient of performance is maximized.

Certain or other embodiments of the present disclosure described above are not mutually exclusive or distinct from each other. Certain or other embodiments of the present disclosure described above may be used in combination or combination of respective components or functions.

For example, configuration A described in a specific embodiment and/or drawing may be combined with configuration B described in another embodiment and/or drawing. That is, even if the combination between the components is not directly explained, it means that the combination is possible except for the case where the combination is impossible.

The above detailed description should not be construed as limiting in all respects and should be considered illustrative. The scope of the present invention should be determined by reasonable interpretation of the appended claims, and all changes within the equivalent scope of the present invention are included in the scope of the present invention.

The invention claimed is:

1. An air conditioner, comprising:

an outdoor unit;

at least one indoor unit configured to cool and heat an indoor space while repeating operation (Thermo-ON) and operation stop (Thermo-OFF);

a sensor unit configured to measure a temperature and humidity of each indoor space where the at least one indoor unit is located; and a controller, wherein the controller calculates a sensible heat load and a latent heat load of each indoor space,

TABLE 1

| | | Existing outdoor fan control logic | | | | | Control logic of the present disclosure | | | | |
|---|---|---|---|---|---|---|---|---|---|---|---|
| Mode | Load | Compressor Hz | Outdoor fan RPM | Cooling capacity kW | Power consumption kW | COP W/W | Compressor Hz | Outdoor fan RPM | Cooling capacity kW | Power consumption kW | COP W/W |
| Cooling | 25% | 17 | 100 | 16.0 | 2.35 | 6.80 | 14 | 440 | 15.1 | 1.52 | 9.95 |
| | 50% | 48 | 230 | 29.9 | 5.12 | 5.83 | 42 | 790 | 30.9 | 3.41 | 9.03 |
| | 75% | 51 | 500 | 44.4 | 11.3 | 3.90 | 48 | 1030 | 44.6 | 9.40 | 4.75 |

Referring to FIG. 9 together with Table 1 below, in the case of 25%, 50%, and 75% of the load, it can be seen that the coefficient of performance B of the air conditioner 10 of the present disclosure is higher than the coefficient of performance A of the conventional air conditioner by 46.3%, 54.9%, and 21.7%, respectively. Referring to FIG. 10, it can be seen that the one-year integrated power consumption B of the air conditioner 10 of the present disclosure is 75% of the based on a time when the operation stop occurs, a time when the operation starts again after the operation stop occurs, and temperature and humidity information of each indoor space, derives a target sensible heat and a target latent heat based on the calculated sensible heat load and latent heat load, and derives a target refrigerant temperature and an air volume of the at least one indoor unit based on the target sensible heat and the target latent heat, wherein the sensor unit measures a first indoor temperature and a first indoor humidity at a first time when the operation stop of the at least one indoor unit occurs, and measures a second indoor temperature and a second indoor humidity at a second time when the operation starts again after the first time, wherein the controller derives a temperature change rate of each indoor space during an operation stop time using the first time, the second time, the first indoor temperature, and the second indoor temperature, and calculates the sensible heat load of each indoor space based on the temperature change rate and a volume of each indoor space, and derives an enthalpy change rate of each indoor space during the operation stop time by using the first time, the second time, the first indoor humidity, and the second indoor humidity, and calculates the latent heat load of each indoor space, based on the enthalpy change rate, the volume of each indoor space, and the sensible heat load.

2. The air conditioner of claim 1, wherein the controller sets the target sensible heat to be larger by a preset ratio in comparison with the sensible heat load, and the controller sets the target latent heat to be larger by a preset ratio in comparison with the latent heat load.

3. The air conditioner of claim 1, wherein the controller determines an operation mode, and when the operation mode is a cooling mode, if the latent heat load is 0, derives the air volume of the at least one indoor unit based on the target sensible heat and a target supply air temperature of the at least one indoor unit, and if the latent heat load is a positive number, derives the air volume of the at least one indoor unit based on the target latent heat.

4. The air conditioner of claim 3, wherein when the operation mode is a heating mode, the controller derives the air volume of the at least one indoor unit based on the target sensible heat and the target supply air temperature of the at least one indoor unit.

5. The air conditioner of claim 4, wherein when the at least one indoor unit comprises a single indoor unit the controller determines the target refrigerant temperature based on the target sensible heat.

6. The air conditioner of claim 1, wherein the controller derives a number of rotations of an outdoor fan that maximizes a coefficient of performance (COP).

7. The air conditioner of claim 6, wherein the coefficient of performance is a value obtained by dividing a heating/cooling capacity by a total power consumption, wherein the total power consumption is a value obtained by adding power consumptions of a compressor, an indoor fan, and the outdoor fan, and wherein the number of rotations of the outdoor fan is derived from a number of rotations satisfying a condition in which a change rate of the total power consumption due to a change in the number of rotations of the outdoor fan is zero.

8. The air conditioner of claim 7, wherein the controller determines an operation mode, and when the operation mode is a cooling mode, calculates an effective heat capacity, calculates a discharge temperature change according to a condensation temperature change, and derives the number of rotations of the outdoor fan by applying the calculated effective heat capacity and the calculated discharge temperature change according to the condensation temperature change to the condition in which the change rate of the total power consumption due to the change in the number of rotations of the outdoor fan is zero.

9. The air conditioner of claim 7, wherein the controller determines an operation mode, and when the operation mode is a heating mode, calculates a dew point temperature, and if the calculated dew point temperature is higher than a heat exchanger temperature, determines the number of rotations of the outdoor fan as a maximum number of rotations, and if the calculated dew point temperature is lower than the heat exchanger temperature, calculates an effective heat capacity, and calculates a discharge temperature change rate according to an evaporation temperature change, and derives the number of rotations of the outdoor fan by applying the calculated effective heat capacity and the calculated discharge temperature change rate according to the evaporation temperature change to the condition in which the change rate of the total power consumption due to the number of rotations of the outdoor fan is zero.

10. The air conditioner of claim 8, wherein the effective heat capacity is a change rate of a difference between discharge enthalpy and suction enthalpy according to the condensation temperature change or the evaporation temperature change.

11. The air conditioner of claim 4, wherein when the at least one indoor unit comprises a plurality of indoor units the target refrigerant temperature is determined further based on a number of the plurality of indoor units, a ratio of rated cooling/heating capacity of each of the plurality of indoor units, a sensible heat exchange effectiveness, an air mass flow of each indoor unit, and an indoor temperature.

* * * * *